US005397234A

United States Patent [19]

Kwiatek

[11] Patent Number: 5,397,234

[45] Date of Patent: Mar. 14, 1995

[54] GAS STOVE TOP BURNER ASSEMBLY

[75] Inventor: David J. Kwiatek, LaGrange, Ill.

[73] Assignee: Harper-Wyman Company, Lisle, Ill.

[21] Appl. No.: 153,228

[22] Filed: Nov. 15, 1993

[51] Int. Cl.[6] ..... F23Q 3/00

[52] U.S. Cl. ..... 431/264; 431/266; 126/39 R; 126/39 E

[58] Field of Search ..... 126/39 R, 39 E, 39 AB; 431/258–266; 239/552, 567, 568

[56] References Cited

U.S. PATENT DOCUMENTS

| | | | |
|---|---|---|---|
| 1,004,291 | 9/1911 | Merrill . | |
| 3,796,535 | 3/1974 | De Goville . | |
| 3,820,399 | 6/1974 | de Gouville . | |
| 3,825,404 | 7/1974 | De Gouville . | |
| 4,518,346 | 5/1985 | Pistien . | |
| 4,626,196 | 12/1986 | Stohrer, Jr. . | |
| 4,690,636 | 9/1987 | Lemmonier de Gouville et al. . | |
| 4,757,801 | 7/1988 | Le Monnier de Gouville et al. . | |
| 4,773,383 | 9/1988 | Le Monnier de Gouville et al. . | |
| 4,810,188 | 3/1989 | Kwiatek . | |
| 4,846,671 | 7/1989 | Kwiatek . | |
| 4,886,043 | 12/1989 | Homer | 126/39 E |
| 4,887,963 | 12/1989 | LeMer . | |
| 4,891,006 | 1/1990 | Le Monnier de Gouville et al. . | |
| 4,953,534 | 9/1990 | De Gouville et al. . | |
| 5,002,038 | 3/1991 | Riehl . | |
| 5,040,970 | 8/1991 | Riehl . | |
| 5,083,915 | 1/1992 | Riehl . | |
| 5,085,202 | 2/1992 | Riehl . | |
| 5,160,256 | 11/1992 | Riehl | 126/39 E |

FOREIGN PATENT DOCUMENTS

| | | | |
|---|---|---|---|
| 147218 | 6/1989 | Japan | 431/264 |
| 7808145 | 2/1980 | Netherlands . | |
| 1543618 | 4/1979 | United Kingdom | 431/266 |
| 2020001 | 11/1979 | United Kingdom | 431/266 |
| 2085576 | 4/1982 | United Kingdom . | |

*Primary Examiner*—James C. Yeung

*Attorney, Agent, or Firm*—Mason, Kolehmainen, Rathburn & Wyss

[57] ABSTRACT

A gas burner assembly is provided for a gas stove. The gas burner assembly includes a burner base and a burner cap mounted by the burner base and defines a plurality of gas burner ports. The burner base and burner cap have cooperating members defining a gas stabilization port. The burner cap and the burner base are connected to electrical ground potential. An electrode assembly for manual spark ignition of the gas burner includes an electrically conductive electrode. An electrically insulative support member mounted by the burner base encloses and positions the electrically conductive electrode proximate to the gas burner. Responsive to a user's manual operation, a high voltage potential is applied to the electrically conductive electrode for spark ignition.

9 Claims, 1 Drawing Sheet

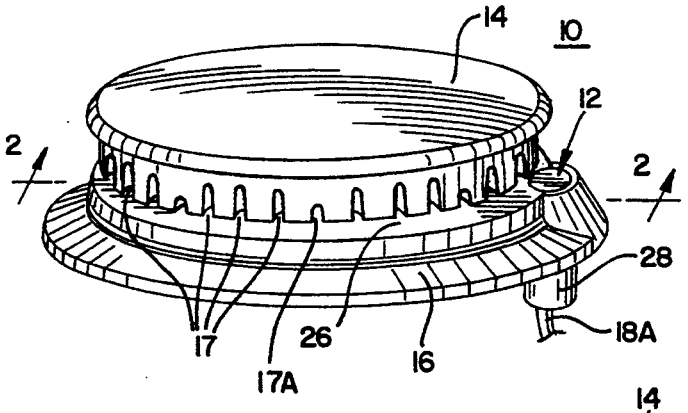
FIG. 1
FIG. 2
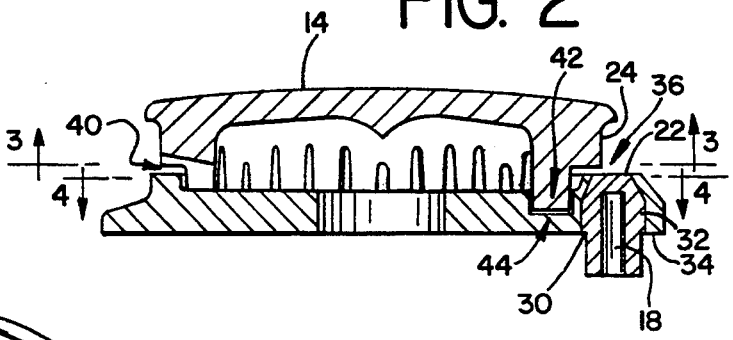
FIG. 3
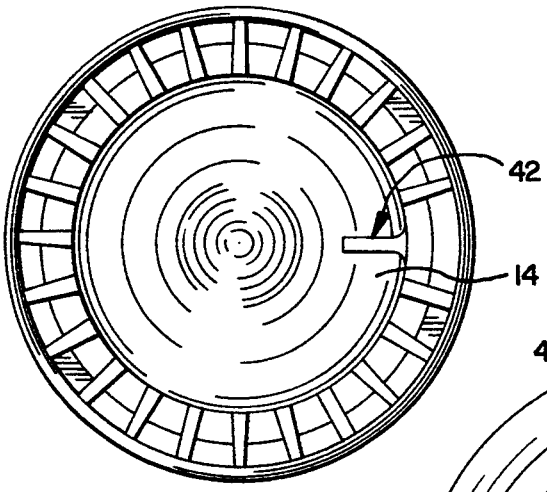
FIG. 4
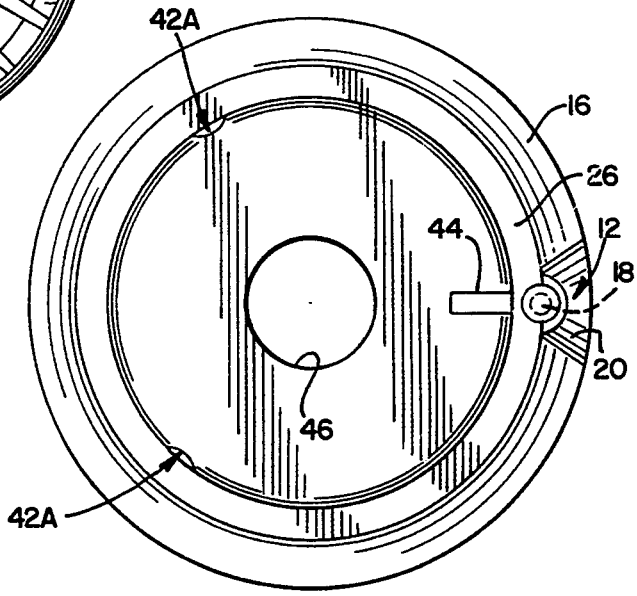

GAS STOVE TOP BURNER ASSEMBLY

RELATED APPLICATION

A related application having Ser. No. 08/152,843 and entitled "Electrode Assembly for Gas Burner Spark Ignition" is being filed contemporaneously by the present inventor and has the same assignee as the present application.

BACKGROUND OF THE INVENTION

1. Field of the Invention

The present invention relates generally to gas burners, and more particularly to an improved gas stove top burner assembly including an electrode for manual spark ignition.

2. Description of the Prior Art

Various arrangements are known in the art for spark ignited gas burners such as gas stove top burners. Many known arrangements include a high voltage electrode positioned relative to a ground member so that a spark will jump between the high voltage electrode and the ground member to ignite the gas when high voltage is applied to the high voltage electrode. Typically the high voltage electrode is positioned by an insulative support member so that an end portion of the electrically conductive wire defining the electrode is located near a grounded burner cap or side-wall. Problems with these arrangements include potential damage to the exposed end of the high voltage electrode during use and that reliable and repeatable operations may not be achieved due to the electrode position. Also, a possibility of electrical shock to the user exists.

U.S. Pat. Nos. 4,810,188 and 4,846,671 assigned to the assignee of the present invention, disclose improved spark ignited gas burner assemblies. While these spark ignited gas burner assemblies provide advantages over various known spark ignited burner assemblies, it is desirable to provide a spark ignited gas burner that eliminates the likelihood of shock to the user while providing reliable and repeatable operations.

SUMMARY OF THE INVENTION

Among the principal objects of the present invention are to provide an electrode for manual ignition of a gas burner; to provide a new and improved spark ignition electrode that provides effective and reliable operation; and to provide a spark ignition electrode overcoming many of the disadvantages of known spark ignition electrode arrangements.

In brief, the objects and advantages of the present invention are achieved by a gas burner assembly for a gas stove. The gas burner assembly includes a burner base and a burner cap mounted by the burner base and defining a plurality of gas burner ports. The burner base and burner cap have cooperating members defining a gas stabilization port. The burner cap and the burner base are connected to electrical ground potential. An electrode assembly for manual spark ignition of the gas burner includes an electrically conductive electrode. An electrically insulative support member mounted by the burner base encloses and positions the electrically conductive electrode proximate to the gas burner. Responsive to a user's manual operation, a high voltage potential is applied to the electrically conductive electrode for spark ignition.

BRIEF DESCRIPTION OF THE DRAWING

The present invention together with the above and other objects and advantages may best be understood from the following detailed description of the embodiment of the invention illustrated in the drawing, wherein:

FIG. 1 is a perspective view of a gas stove top burner assembly constructed in accordance with the principles of the present invention;

FIG. 2 is a cross-sectional view taken along the line 2—2 of FIG. 1;

FIG. 3 is an enlarged cross-sectional view taken along the line 3—3 of FIG. 1;

FIG. 4 is a cross-sectional view taken along the line 4—4 of FIG. 3.

DETAILED DESCRIPTION OF THE PREFERRED EMBODIMENT

Referring now to the drawing, in FIGS. 1–4 there is illustrated a gas stove top burner assembly generally designated as a whole by the reference character 10 and arranged in accordance with principles of the present invention.

Having reference initially to FIGS. 1 and 2, the burner assembly 10 includes a spark electrode assembly generally designated by the reference character 12, a burner cap 14 and a burner base 16. A plurality of burner ports 17 and 17A are defined within the lower sidewall of the burner cap 14. Burner ports 17A are smaller in height to ports 17 in order to reduce the flame size. This pattern of ports 17A coincides with the burner grate fingers. Spark electrode assembly 12 eliminates many disadvantages of conventional spark ignition arrangements by having an electrically conductive spark electrode 18 contained within and positioned by an electrically insulative support member 20. An easily cleaned range configuration is enabled, while the likelihood of electrical shock to the user is eliminated.

A high voltage wire 18A connects the electrically conductive spark electrode 18 to a source of high voltage potential. Spark electrode 18 is an integral member formed of electrically conductive material, such as #310 stainless steel. The burner cap 14 and burner base 16 are provided at electrical ground potential. The burner cap 14 and burner base 16 are connected to an electrical ground potential with the gas stove top so that a separate ground connection and an insulative space member are not required.

A thin section 22 of the electrically insulative support member 20 is located between the spark electrode 18 and a portion generally designated 24 of the gas burner cap 14. Electrically insulative support member 20 is formed of a ceramic material, for example, such as cordierite, a self glaze material. Section 22 has a predetermined thickness that is selected to provide a cover for the electrode 18 while allowing a high voltage applied to the spark electrode to discharge through the ceramic material. Section 22 is disposed at the same level or flush with an upper surface 26 of the burner base 16 to provide an easily cleanable burner assembly 10. The ceramic section 22 is easily washable and conceals the high voltage spark electrode 18 to eliminate the possibility of electrical shock to the user while providing reliable and repeatable operations.

Electrically insulative support member 20 includes a lower body portion 28 that is slideably received through an aperture 30 in the gas burner base 16. An upper body portion 32 of support member 20 engages a stop 34 defined by the gas burner base 16 to position the thin section 22 flush with the upper base surface 26. A user's manual operation for spark ignition provides a high voltage potential to the spark electrode 18 of the spark electrode assembly 12. The high voltage potential causes sparks to be produced at a spark gap generally designated at 36, or through the gasway, for providing reliable and repeatable spark ignition operations.

Referring to FIG. 2, an important feature of the invention is shown. A secondary stability gas, ignition gas, and carry-around gas generally designated by 40 is formed by gas coming out of ports 17 and 17A and accumulating in the groove formed by the cooperating portions of the burner cap 14 and the burner base 16.

Referring also to FIGS. 3 and 4, gas burner cap 14 includes one lug or a downwardly depending leg 42 that is received within a cooperating locating hole 44 formed within the base 16. Two half circles, 42A are formed in the gas burner base 16 at 120°, functioning as a tightening bulge, to limit the movement of the cap 14. The main gas burner ports 17 and grate finger ports 17A provide primary air-gas fuel from a central aperture of the gas burner base 16. Secondary stability air-gas fuel is provided by the small gap 40.

Gas burner cap 14 and the gas burner base 16 advantageously are formed of an aluminum material, for example, such as 43 alloy aluminum.

While the invention has been described with reference to details of the illustrated embodiment, these details are not intended to limit the scope of the invention as defined in the appended claims.

What is claimed and desired to be secured by Letters Patent is:

1. A gas burner assembly for a gas stove comprising:

a burner base;

a burner cap mounted by said burner base and defining a plurality of gas burner ports;

said burner base and said burner cap having cooperating means defining a gas stabilization port;

said burner cap and said burner base being connected to electrical ground potential;

an electrode assembly for manual spark ignition of said gas burner assembly including;

an electrically conductive electrode;

an electrically insulative support member mounted by said burner base enclosing and positioning said electrically conductive electrode proximate to the burner cap; said electrically insulative support member having a predetermined wall thickness between said electrically conductive electrode and said burner cap to allow a high voltage discharge through said wall thickness; and means responsive to a user's manual operation for applying a high voltage potential to said electrically conductive electrode.

2. A gas burner assembly for a gas stove as recited in claim 1 wherein said gas stabilization port is defined by a small gap between said burner cap and said burner base.

3. A gas burner assembly for a gas stove as recited in claim 1 wherein said burner cap includes a downwardly depending leg and wherein said burner base includes a cooperating locating hole receiving said leg for positioning said burner cap.

4. A gas burner assembly for a gas stove as recited in claim 3 wherein said burner base further includes a pair of half circles for positioning said burner cap.

5. A gas burner assembly for a gas stove as recited in claim 1 wherein said burner cap and said burner base are formed of an aluminum material.

6. A gas burner assembly for a gas stove as recited in claim 5 wherein said burner cap and said burner base are formed of 43 alloy aluminum.

7. A gas burner assembly for a gas stove as recited in claim 1 wherein said gas stabilization port provides stability and ignition gas all around said burner cap.

8. A gas burner assembly for a gas stove as recited in claim 7 wherein said plurality of gas burner ports provide primary air-gas fuel for the gas burner assembly.

9. A gas burner assembly for a gas stove comprising:

a burner base;

a burner body mounted by said burner base and defining a plurality of gas burner ports;

said burner base and said burner body having cooperating means defining a gas stabilization port; said burner body and said burner base being connected to electrical ground potential;

an electrode assembly for manual spark ignition of said gas burner including;

an electrically conductive electrode;

an electrically insulative support member mounted by said burner base enclosing and positioning said electrically conductive electrode proximate to the burner body; said electrically insulative support member having a predetermined wall thickness between said electrically conductive electrode and said burner body to allow a high voltage discharge through said wall thickness; and means responsive to a user's manual operation for applying a high voltage potential to said electrically conductive electrode.

* * * * *